US005769672A

United States Patent [19]

Flieger

[11] Patent Number: 5,769,672

[45] Date of Patent: Jun. 23, 1998

[54] CONTACT SPRING WITH CONTACT PREOPENING

[75] Inventor: Richard Flieger, Stammham, Germany

[73] Assignee: Siemens Aktiengesellschaft, Munich, Germany

[21] Appl. No.: 721,563

[22] Filed: Sep. 26, 1996

[30] Foreign Application Priority Data

Sep. 27, 1995 [DE] Germany ..... 195 35 960.7

[51] Int. Cl.[6] ..... H01R 11/22

[52] U.S. Cl. ..... 439/850

[58] Field of Search ..... 439/850, 851, 439/852, 856, 857, 845, 849, 842, 886

[56] References Cited

U.S. PATENT DOCUMENTS

| | | | |
|---|---|---|---|
| 2,289,172 | 7/1942 | Beal | 439/857 |
| 3,585,573 | 6/1971 | Robshaw | 439/886 |
| 4,534,611 | 8/1985 | Wohlfart | 439/857 |
| 4,877,409 | 10/1989 | Tanigawa et al. | 439/857 |
| 5,295,874 | 3/1994 | Yoneda et al. | 439/850 |
| 5,395,270 | 3/1995 | Jinno et al. | 439/850 |
| 5,611,716 | 3/1997 | Egenolf | 439/857 |

FOREIGN PATENT DOCUMENTS

| | | | |
|---|---|---|---|
| 883776 | 7/1953 | Germany | 439/857 |
| 3242635 | 9/1983 | Germany | 439/850 |
| 9202365.7 | 7/1993 | Germany . | |

OTHER PUBLICATIONS

AMP Catalog 82750, Revised Jul. 1995, p. 6046, Standard–Timer Contacts.

*Primary Examiner*—Gary F. Paumen
*Assistant Examiner*—Tho D. Ta
*Attorney, Agent, or Firm*—Herbert L. Lerner; Laurence A. Greenberg

[57] ABSTRACT

In order to provide a contact preopening of two spring legs of a contact spring, at least one spring leg is provided in a contact zone with a cusp in the form of a protrusion pointing to the other spring leg in the region of at least one long edge. The cusp is formed by embossing, without cutting through material, so as not to create free cut edges that would be vulnerable to corrosion, and so as to prevent the introduction of a plug contact from being impaired by skewed contact preopening spacer elements.

5 Claims, 2 Drawing Sheets

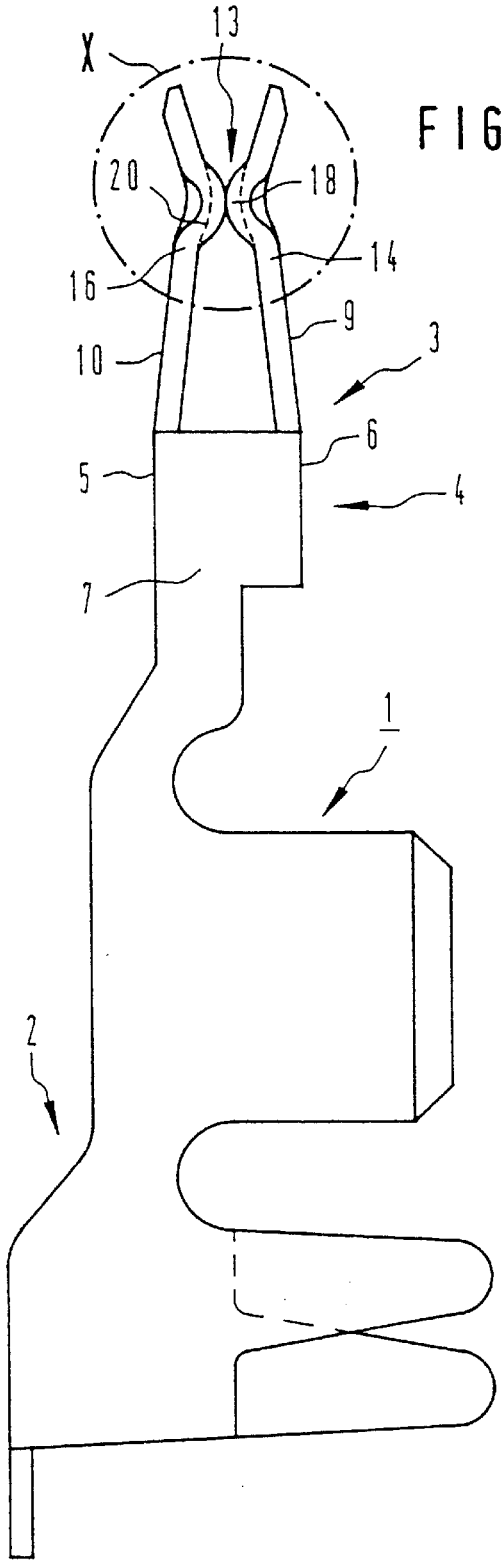
FIG 2
FIG 3
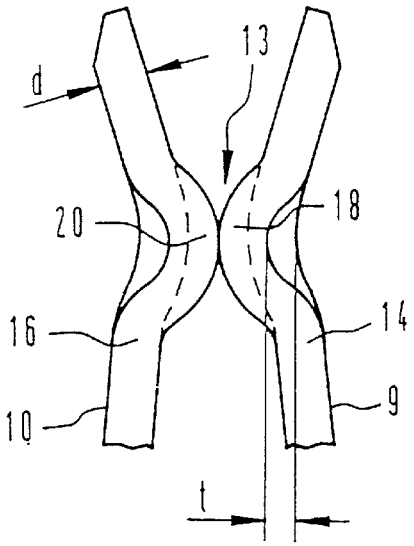

CONTACT SPRING WITH CONTACT PREOPENING

BACKGROUND OF THE INVENTION

Field of the Invention

The invention relates to a contact spring having a terminal part for an electrical conductor and a contact part with a spring leg base and spring legs extending from it for contacting a plug contact, at least one spring leg is constructed in a contact zone with a protrusion pointing at the other spring leg, for a contact preopening.

One such contact spring is known from German Utility Model G 92 02 365 U1, for example.

In the known contact spring, a contact preopening is provided in the form of a tab that is torn out of one long edge of one spring leg and is bent in hooklike fashion toward the other spring leg, to reduce the forces of insertion and extraction when a plug connection is made or disconnected. The two spring legs are kept spaced apart in the contact zone through the use of the tab of the one spring leg that rests on the other spring leg, so that a plug contact can be inserted between the two spring legs without requiring that spring legs which rest on one another with full spring force be spread apart by an increased plug insertion force when a plug is being plugged in. Such spacer elements that are torn out of a spring leg form free cut edges in the contact zone which are vulnerable to corrosion, and if they are skewed, bending or canting might impair or even entirely prevent the insertion of a plug contact.

SUMMARY OF THE INVENTION

It is accordingly an object of the invention to provide a contact spring with a contact preopening, which overcomes the hereinafore-mentioned disadvantages of the heretofore-known devices of this general type and which provides an improved, simple solution for a contact preopening.

With the foregoing and other objects in view there is provided, in accordance with the invention, a contact spring, comprising a terminal part for an electrical conductor; and a contact part having a spring leg base and spring legs extending from the spring leg base for contacting a plug contact in a contact zone; the spring legs having long edges, and at least one of the spring legs having a protrusion in the contact zone pointing at the other of the spring legs for a contact preopening, the protrusion for the contact preopening being a cusp embossed into one of the spring legs in the region of at least one of the long edges without cutting through material.

Such a contact spring is provided with one or more embossed cusps, which maintain the spacing between the spring legs, without cutting through the spring leg material. In this way a contact preopening is formed without creating free cut edges in the contact zone that are vulnerable to corrosion. Since the contact preopening is formed by the embossing of cusps, a skewed position of the spacer elements, which do not protrude freely from the material of a spring leg but instead remain integrated with the material of the spring leg, is precluded, and thus the contact preopening can no longer impair the insertion of a plug contact between the spring legs.

In accordance with another feature of the invention, the contact part has two spring legs each having a respective cusp at least on one identical long side.

In accordance with a concomitant feature of the invention, the spring legs are wide and/or longitudinally divided, and each of the spring legs has two outer long edges and a respective cusp on each of the two outer long edges.

Other features which are considered as characteristic for the invention are set forth in the appended claims.

Although the invention is illustrated and described herein as embodied in a contact spring with contact preopening, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2 is a side-elevational view of a contact spring; and

FIG. 3 is an enlarged, fragmentary, side-elevational view of a portion X of FIG. 2.

DESCRIPTION OF THE PREFERRED EMBODIMENTS

Figure 1:
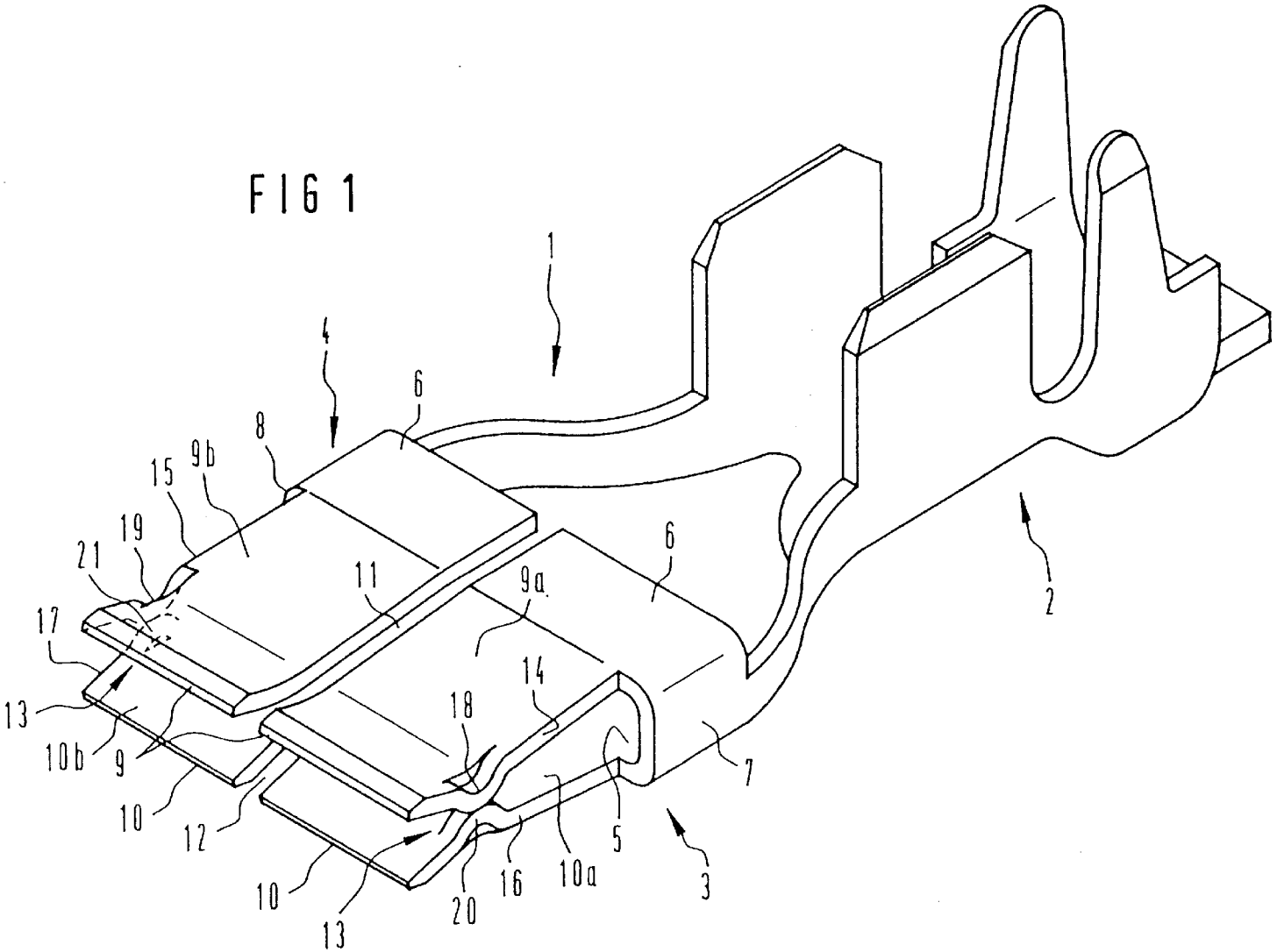
FIG. 1 is a diagrammatic, perspective view of a contact spring.

Referring now to the figures of the drawings in detail and first, particularly, to FIGS. 1 and 2 thereof, there is seen a contact spring 1 which includes a terminal part 2 that is constructed, for instance, as a crimped terminal, to which a contact part 3 is connected by a spring leg base 4. In this case, the spring leg base 4 has a right-angled cross section with a bottom wall 5, a top wall 6 and two side walls 7 and 8.

In order to lengthen the bottom wall 5 and the top wall 6 on the side facing toward a plug, the contact part 3 has two spring legs 9 and 10 for contacting a plug contact. In the contact spring shown, the spring legs 9 and 10 are split longitudinally, with one spring leg 9 having in a continuous longitudinal slit 11 resulting from bending the spring leg base 4 for production reasons, and the other spring leg 10 having a longitudinal slit 12 that extends as far as the bottom wall 5. This creates a double flat contact spring in which each spring leg 9 and 10 is formed by two respective spring laminations 9*a*, 9*b* and 10*a*, 10*b*. The spring laminations 9*a*, 9*b* and 10*a*, 10*b* begin at the spring leg base 4 and initially extend toward one another, up to a contact zone 13. From this contact zone, the spring laminations 9*a*, 9*b* and 10*a*, 10*b* diverge in funnel-like fashion. Thus the spring laminations do not extend rectilinearly in the same plane, but instead bend toward one another somewhat in the contact zone 13 and then diverge again, as is clearly shown in FIGS. 1–3.

In order to form a contact preopening, each spring lamination 9*a*, 9*b*, 10*a*, 10*b* is provided with a respective cusp 18, 19, 20, 21 aimed at the opposed spring lamination, in the region of respective outer long edges 14, 15 and 16, 17 in the contact zone 13, that is where the spring laminations bend toward one another. In the case of a contact spring 1 which is produced as a stamped and shaped part, these cusps are formed by embossing. The embossing operations are performed in such a way that no free cut edges are created in the spring laminations, and a material thickness d of a spring lamination is not cut through, as is clearly shown in FIGS. 1–3. This means that a depth t of the embossing, or of the cusps 18–21, is less in each case than the thickness d of a spring lamination shown in FIG. 3. In the illustrated exemplary embodiment of a contact spring according to FIG. 1, a total of four cusps 18–21 that produce a contact preopening are thus created along the outer long edges of the spring laminations. However, it is also conceivable, given a suitable embodiment of a contact spring, for instance with a lesser width of the spring legs than in the embodiment shown, to provide only one cusp as a contact preopening, and to emboss it in the region of one long edge of a spring leg, in the contact zone.

I claim:

1. A contact spring, comprising:

a terminal part for an electrical conductor;

a contact part having a spring leg base and spring legs extending from said spring leg base for contacting a plug contact in a contact zone; and said spring legs having long edges, and at least one of said spring legs having a protrusion in said contact zone pointing at and contacting the other of said spring legs for maintaining a minimal distance between said spring legs in said contact zone for forming a contact preopening defining a spring tension, said protrusion for said contact preopening being a cusp embossed into one of said spring legs in a region of at least one of said long edges without cutting through material forming said spring legs.

2. The contact spring according to claim 1, wherein said contact part has two spring legs each having a respective cusp at least on one identical long side.

3. The contact spring according to claim 1, wherein said spring legs are wide and longitudinally divided, and each of said spring legs has two outer long edges and a respective cusp on each of said two outer long edges.

4. The contact spring according to claim 1, wherein said spring legs are wide, and each of said spring legs has two outer long edges and a respective cusp on each of said two outer long edges.

5. The contact spring according to claim 1, wherein said spring legs are longitudinally divided, and each of said spring legs has two outer long edges and a respective cusp on each of said two outer long edges.

* * * * *